United States Patent [19]

Rymarchyk et al.

[11] 4,272,989

[45] Jun. 16, 1981

[54] INSTRUMENT LANCE FOR BASIC OXYGEN STEELMAKING FURNACE

[75] Inventors: Nicholas M. Rymarchyk, Wexford; Leo L. Meinert, Baden, both of Pa.

[73] Assignee: Pullman Berry, Harmony, Pa.

[21] Appl. No.: 71,901

[22] Filed: Sep. 4, 1979

[51] Int. Cl.[3] ..... C21D 1/00; G01K 1/12

[52] U.S. Cl. ..... 73/432 R; 73/343 R; 136/234; 266/78

[58] Field of Search ..... 73/432 R, 359 R; 136/234

[56] References Cited

U.S. PATENT DOCUMENTS

| | | | |
|---|---|---|---|
| 3,011,005 | 11/1961 | Silver | 136/234 |
| 3,161,499 | 12/1964 | Percy | 75/60 |
| 3,475,967 | 11/1969 | Steinbach | 73/425.4 R |
| 3,530,716 | 9/1970 | Truppe et al. | 136/234 X |
| 3,672,222 | 6/1972 | Stelts et al. | 136/234 X |
| 3,701,518 | 10/1972 | Herff | 266/34 R |
| 3,727,897 | 4/1973 | Bennett | 266/34 R |
| 4,015,475 | 4/1972 | Pluschkell et al. | 73/432 R X |

*Primary Examiner*—Daniel M. Yasich

*Attorney, Agent, or Firm*—Stephen D. Geimer; Richard J. Myers

[57] ABSTRACT

A lance assembly for insertion into a steelmaking vessel includes a sensor instrument supporting nozzle assembly which projects outwardly from the lance and which is cooled by water circulation. The lance has provisions for the inclusion of an inert gas which is directed into a reduced diameter cable enclosing pipe connected to the nozzle supporting the sensor instrument.

13 Claims, 10 Drawing Figures

INSTRUMENT LANCE FOR BASIC OXYGEN STEELMAKING FURNACE

BACKGROUND OF THE INVENTION

1. Field of the Invention

The present invention pertains to the field of oxygen blowing lances which are inserted into a basic oxygen vessel in the process of making steel. More specifically the invention relates to a lance similar to the oxygen lances utilized in making steel but also includes provisions for the mounting of a sensor instrument which is attached to the nozzle of the lance and which is adapted to take readings concerning conditions within the furnace. A related patent application assigned to applicants assignee is Ser. No. 737,637 filed Nov. 1, 1976, issued Aug. 15, 1978 as U.S. Pat. No. 4,106,756.

2. Description of the Prior Art

Typical arrangements for sensor-type lances are shown in U.S. Pat. Nos. 3,161,499, Dec. 15, 1964, and 3,672,222, June 27, 1972, which employ electrical sensors for measuring molten bath temperatures. Similarly, U.S. Pat. Nos. 3,701,518 and 3,727,897 illustrate lances which use radar-type sensors to gauge the positioning of the lance within a vessel. The present invention is an improvement over the aforementioned patents in that it discloses a structure which is entirely different and novel. The present invention includes an inner chamber provided by a central pipe having at its upper end a funnel shaped pipe portion associated with structure in the nozzle region of the lance to which the sensor device is connected.

SUMMARY OF THE INVENTION

The present lance assembly includes a top adapter head which is secured to a first outer pipe section and which supports a bushing sleeve projecting downwardly into the first pipe section. The bushing sleeve is in sliding engagement with a piston sleeve in turn also slidably associated with a stub sleeve secured to a removable top plate which supports a pipe through which a sensor cable is directed into the lance assembly. The piston sleeve is connected to a funnel shaped pipe portion which in turn communicates with a central pipe extending downwardly to the nozzle portion of the lance and which includes an extension projecting downwardly outwardly from the lance for removably supporting an instrument or sensor device. The nozzle is of a unique design and is attached to the lower ends of the pipes including a central tubular stub which envelopes the lower end of the central pipe and also supports the tubular sensor support member. The lance also is provided with water inlet and outlet passages formed by a concentric pipe formation whereupon the lance and sensor support are cooled during immersion into the steelmaking vessel.

DESCRIPTION OF THE PREFERRED EMBODIMENT

Figure 1:
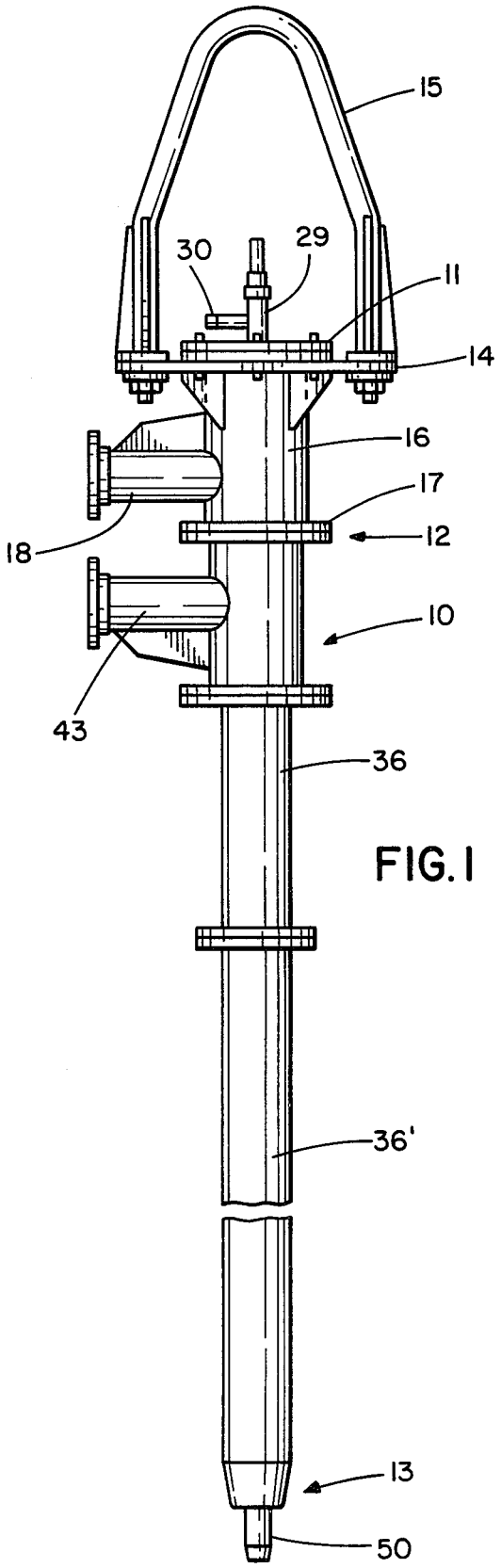
FIG. 1 is an elevational view of a steel-making lance having mounting means for a sensor instrument.
Figure 2:
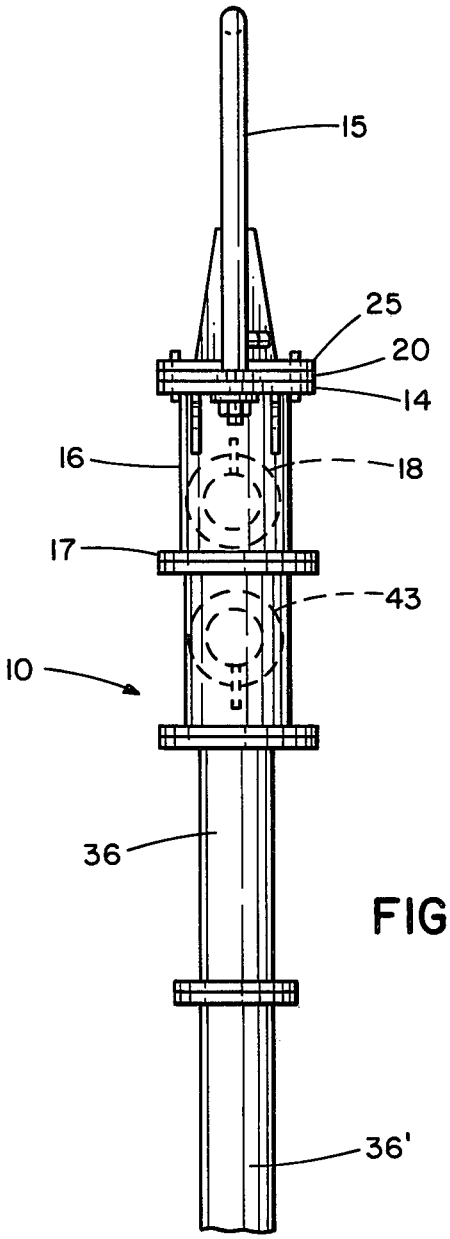
FIG. 2 is a side elevational view of a portion of a lance shown in FIG. 1.
Figure 3:
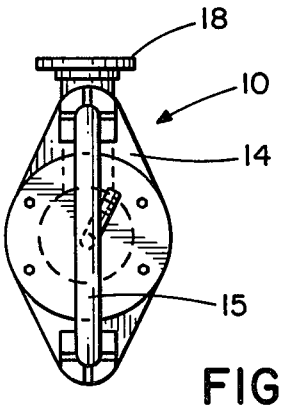
FIG. 3 is a plan view of the upper portion of the lance shown in FIGS. 1 and 2.
Figure 4:
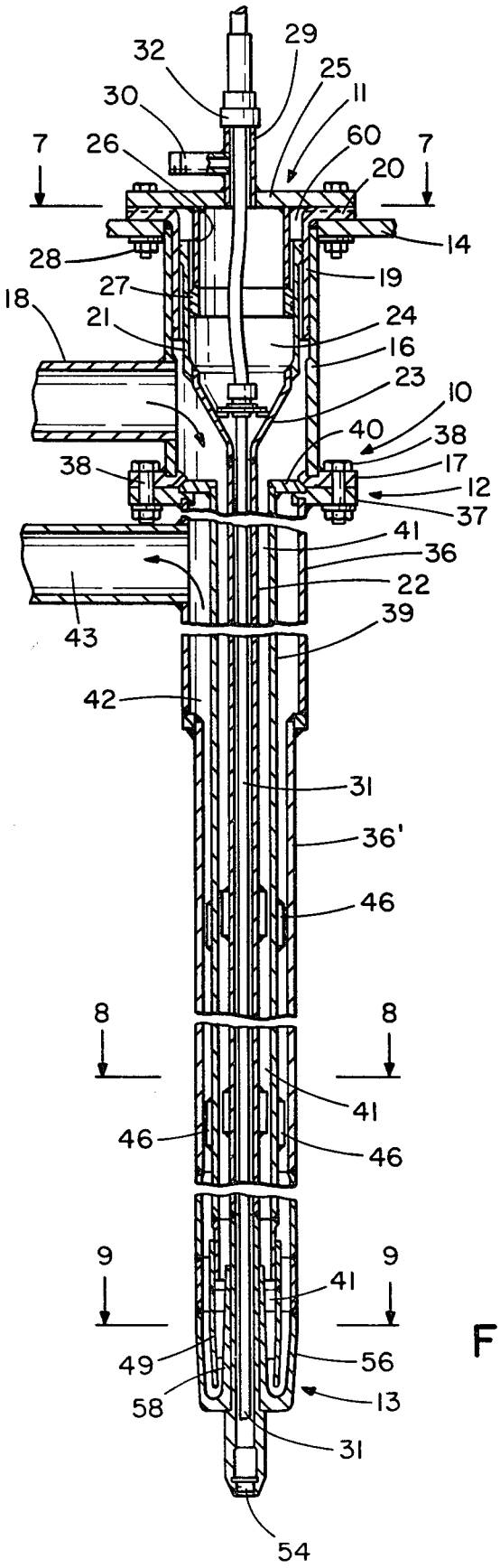
FIG. 4 is a cross-sectional view of the instrument supporting lance.

Referring now particularly to FIGS. 1 and 4 a sensor instrument lance assembly 10 comprises a top adapter head 11 including a disconnect flange assembly 12. The lower portion of the lance includes a nozzle head 13. The upper end of the lance is provided with an upper or first horizontal flange 14 which suitably supports a bail assembly 15 provided to suspend the lance from a suitable crane or hoist arrangement. The sensor lance assembly 10 comprises a first upper pipe section 16 having at its lower end a flange 17. A water inlet connection is designated at 18 and is in communication and connected to the upper pipe section 16. The top adapter head 11 includes a bushing sleeve 19 in telescopic engagement with the pipe 16 and also includes an upper or second horizontal flange 20 seated upon the flange 14. A piston sleeve 21 is at its upper end in relative sliding engagement with respect to the inner surface of the bushing sleeve 19. The piston sleeve 21 is connected to a second central pipe 22 by means of a funnel shaped connecting member or pipe portion 23. Thus the piston sleeve 21 with the funnel shaped pipe portion 23 provides an enlarged chamber designated at 24.

Figure 5:
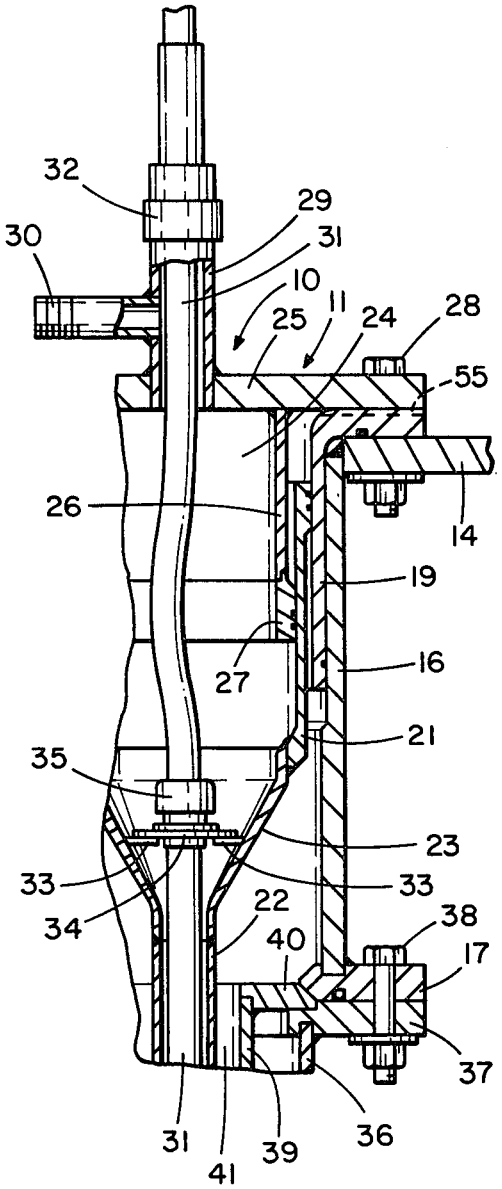
FIG. 5 is an enlarged fragmentary view of the upper portion of the instrument lance showing the adapter head and relative upper sliding connection of the lance pipes.

A top plate 25 is removably connected to the flanges 20 and 14 by means of bolt and nut assemblies 28. The top plate has connected thereto underneath the lower surface thereof a stub sleeve 26 which projects downwardly and includes a piston portion 27 in relative sliding engagement with the inner surface of the piston sleeve 21. A pipe stub 29 is connected to the top plate 25 and projects upwardly with respect thereto as best shown in FIGS. 4 and 5. A nipple or gas inlet tube 30 is connected to the pipe stub 29 for directing an inert gas from a suitable source downwardly into the chamber 24 and throughout the central pipe 22. A cable designated at 31 extends downwardly within the pipe 29 through the chamber 24 and down inwardly into a sensor support member 50. A cable connector 32 firmly supports the cable 31 at the upper end of the pipe 29. As best shown in FIG. 5, cable support ears 33 project outwardly from the inner surfaces of the funnel shaped pipe portion 23 and are suitably connected by conventional means to a flat plate 34 supporting a tubular sleeve guide 35 in turn supporting the cable 31. The ears 33 are designed to permit the flow of gas from the chamber 24 through the pipe 22.

Figure 6:
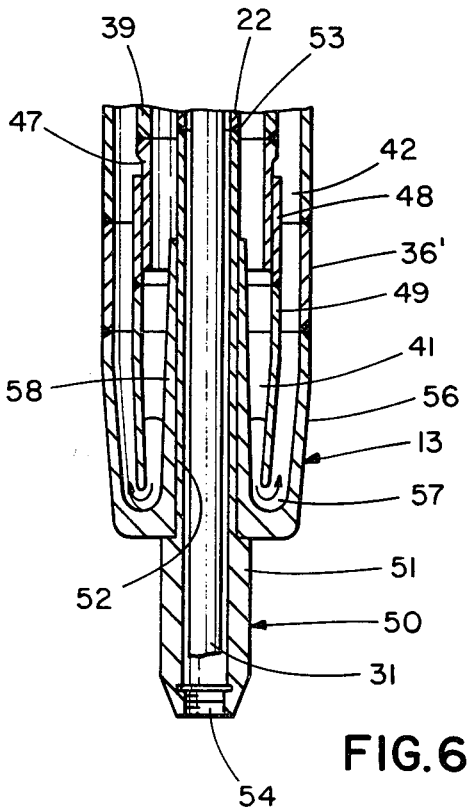
FIG. 6 is an enlarged sectional view of the lower portion of the lance including a nozzle and support for a sensor instrument.

A lower outer pipe portion or fourth outer pipe 36 includes an upper flange 37 which is removably connected to the lower flange 17 of the adapter head 11. The flange 37 thus forms a portion of the disconnect flange assembly 12 and bolt and nut assemblies 38 suitably connect the flanges together. As best shown the pipe 36 is in communication with a lower pipe 36' forming a continuation thereof. An intermediate pipe or third inner pipe 39 extends downwardly substantially the length of the lance, as best shown in FIGS. 4 and 6, and is provided at its upper end with a flange 40 forming a portion of the disconnect flange assembly 12. The pipes 22 and 39 form a water inlet passage 41. The pipes 39 and 36–36' form a water outlet passage 42. The outlet passage 42 is in communication with the outlet pipe 43.

Figure 7:
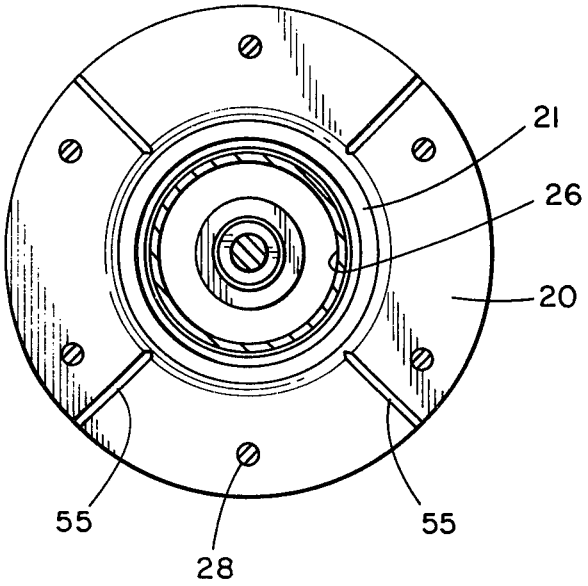
FIG. 7 is a cross-sectional view taken substantially along the line 7—7 of FIG. 4.
Figure 8:
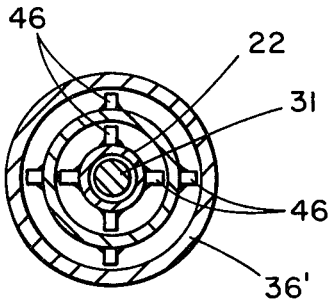
FIG. 8 is a cross-sectional view taken substantially along the line 8—8 of FIG. 4.

As best shown in FIGS. 4 and 8, spacers 46 are connected to the pipes at longitudinally spaced portions thereof for providing suitable spacing between adjacent pipe portions. As best shown in FIG. 6, the intermediate pipe 39 includes a lower extension 47 which is in relative sliding engagement with a pipe portion 48. The nozzle head 13 includes an inner pipe portion 49 which is suitably connected to the pipe portion 48 in sliding engagement with the pipe extension 47. The sensor support member 50, as best shown in FIG. 6, projects downwardly and outwardly of the nozzle head 13. The support member 50 includes a reduced diameter tubuler extension 52 which projects upwardly through the nozzle head 13 and is suitably welded as indicated at 53, as shown in FIG. 6, to the lower end of the pipe 22. The sensor support member 50 is provided with a female threaded orifice 54 to which a sensor instrument may be connected which in turn includes electrical components connected to the cable 31. A central tubular extension 58 is integrally formed in the nozzle head 13 and envelopes the extension 52 providing a reinforced extension for the reduced diameter tubular member 52. As shown in FIGS. 5 and 7, vent passages 55 vent a chamber 60 in the upper portion of the lance structure shown in FIG. 4.

Figure 9:
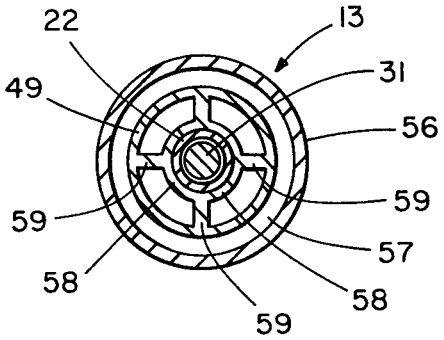
FIG. 9 is a cross-sectional view taken along substantially along the line 9—9 of FIG. 4.

As best shown in FIGS. 6 and 9 the nozzle head 13 includes an outer cylinder wall 56 with which the pipe extension or wall 49 provides a cooling chamber 57. The extension or stub 58 is connected to the pipe extension 49 by means of circumferentially spaced walls 59.

Figure 10:
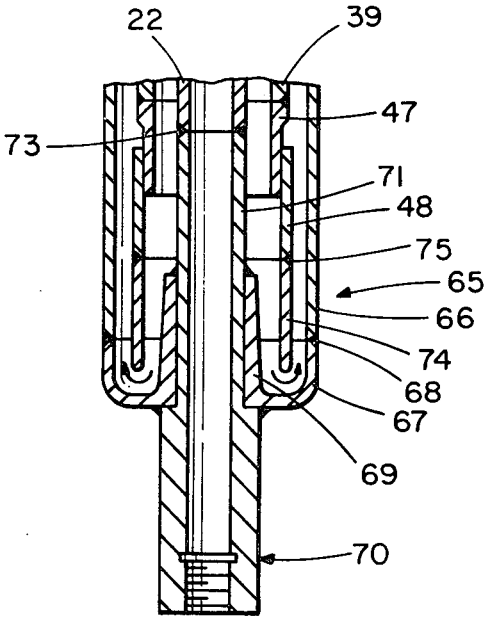
FIG. 10 is an enlarged sectional view of the lower portion of a lance including a modified nozzle and support for a sensor instrument.

FIG. 10 discloses a modified nozzle arrangement generally indicated at 65. The nozzle 65 includes an outer cylindrical wall 66 substantially similar to the lower pipe 36' of FIG. 6, and has connected thereto at its lower end a skirt portion 67 welded thereto as indicated at 68. The skirt has a tubular stub portion 69 which is connected to a sensor support member 70, having an upwardly extending tubular extension 71 connected to the central pipe 22 by a weld 73. The pipe 39 includes the lower extension 47, also shown in FIG. 6 which is in relative sliding engagement with the pipe portion 48. A lower pipe section 74 is welded to the pipe portion 48 by means of a weld 75. The cable 31, of course, also extends through the nozzle to a suitable sensor (not shown) in the same manner as in the preferred embodiment.

Operation

The present lance design may support a sensor instrument within the vessel which can be utilized for measuring and providing readings relating to the carbon content and temperature within the furnace bath. The inert gas pressurizes the chamber 24 as well as the pipe 22. Flow of cooling liquid to and from the cooling chamber is conventional for cooling the outer and interior surfaces of the lance. The lance is particularly designed to accommodate the vertical expansion that occurs during the steelmaking process and the provision for the relative sliding movement of the piston heads and piston portions forming part of the top adapter assembly accommodates the relative expansion. Further, the top adapter assembly is readily removable for servicing the lance with ready access to the interior portions thereof.

The nozzle construction including the central tubular stub 58 provides for reinforcement of the reduced diameter tubular extension 52 and effective cooling of the sensor support member is effected. The present construction therefore is particularly adaptable to all types of sensor devices which are electrically activated by a cable connection.

What is claimed is:

1. A sensor lance for insertion into a vessel for monitoring process conditions for molten metal comprising:

a top adapter head including a first upper pipe section having an upper first horizontal flange, a bushing sleeve spaced inwardly of said first upper pipe section having a tubular vertical portion in engagement with said first upper pipe section and including a second horizontal flange for connecting said bushing sleeve to said first horizontal flange, a piston sleeve spaced inwardly of said bushing sleeve having an enlarged upper chamber, said piston sleeve being in sliding engagement within said bushing sleeve, a central second pipe connected to and communicating with said piston sleeve, a connecting member means connecting a relatively small diameter portion of the central second pipe to a relatively larger diameter portion of the piston sleeve for facilitating water flow thereabout, a top horizontal plate connecting said first and second flanges, a stub sleeve spaced inwardly of said piston sleeve and connected to said top plate projecting into said enlarged upper chamber, said stub sleeve being in relative sliding engagement with said piston sleeve to accommodate differential thermal expansion, a water inlet connection on said first upper pipe section, a third inner pipe spaced outwardly from said second central pipe to provide a water inlet passage communicating with said water inlet connection, a fourth outer pipe concentric with and spaced outwardly from said third inner pipe to provide a water outlet passage, a water outlet connection on said fourth outer pipe communicating with said water outlet passage, a nozzle head connected to the lower portions of said fourth outer and central second pipes and including water cooling passages communicating with said water inlet and outlet passages, a gas inlet tube connected to said top plate to provide a gas inlet into said enlarged upper chamber, electrical cable means supported within said gas inlet tube and extending within said second central pipe, a tubular sensor support means supported on and projecting outwardly from said nozzle head, said central second pipe communicating with said tubular sensor support means and said electrical cable means extending within said sensor support means, and said sensor support means being adapted to connect and support a sensor device connected to said cable means.

2. The invention in accordance with claim 1, said gas inlet tube including a pipe nipple adapted to connect to a source of inert gas.

3. The invention in accordance with claim 1 and said connecting member means having a decreasing cross-section.

4. The invention in accordance with claim 1, including cable support means positioned between said second central pipe and said piston sleeve.

5. The invention in accordance with claim 1, including cable support means supported within said connecting member means.

6. The invention in accordance with claim 1, said sensor support means having a tubular threaded end portion communicating with said second pipe.

7. The invention in accordance with claim 1, said nozzle head having a central tubular stub projecting upwardly into said lance and embracing said second central pipe.

8. The invention in accordance with claim 7, said second central pipe including a pipe section formed integral with said sensor support means.

9. The invention in accordance with claim 8, said pipe section extending upwardly above said tubular stub portion and being connected to said second central pipe.

10. The invention in accordance with claim 1, said enlarged upper chamber and said central pipe being in communication with said gas inert tube.

11. The invention in accordance with claim 1, a bail assembly connected with said top adapter head.

12. The invention in accordance with claim 1, and introduction of inert gas through said gas inlet tube to pressurize said enlarged upper chamber and central second pipe to prevent destruction of said electrical cable means.

13. The invention in accordance with claim 12, and a vent chamber and vent passages within said top adapter head to vent leakage of said inert gas between said stub sleeve and said piston sleeve.

* * * * *